US008640414B2

(12) United States Patent
Reyes, II

(10) Patent No.: US 8,640,414 B2
(45) Date of Patent: Feb. 4, 2014

(54) FULLY INSULATED GLASS PANEL ROLLING DOOR

(76) Inventor: Robert A. Reyes, II, Temple City, CA (US)

( * ) Notice: Subject to any disclaimer, the term of this patent is extended or adjusted under 35 U.S.C. 154(b) by 1214 days.

(21) Appl. No.: 11/634,449

(22) Filed: Dec. 5, 2006

(65) Prior Publication Data

US 2007/0272371 A1 Nov. 29, 2007

Related U.S. Application Data

(60) Provisional application No. 60/808,203, filed on May 24, 2006.

(51) Int. Cl.
*E06B 3/70* (2006.01)

(52) U.S. Cl.
USPC ..... 52/455; 52/784.1; 160/219

(58) Field of Classification Search
USPC ..... 52/455, 784.1, 783.12; 160/201, 219, 160/236
See application file for complete search history.

(56) References Cited

U.S. PATENT DOCUMENTS

| | | | | | |
|---|---|---|---|---|---|
| 2,956,314 | A | * | 10/1960 | Rowe et. al. | 52/204.57 |
| 3,204,324 | A | * | 9/1965 | Fridthjov | 29/897.312 |
| 3,466,826 | A | * | 9/1969 | Gallagher et. al. | 52/395 |
| 4,214,415 | A | * | 7/1980 | Sukolics | 52/395 |
| 4,452,293 | A | | 6/1984 | Gorse | |
| 4,463,540 | A | * | 8/1984 | Gordon | 52/235 |
| 4,567,931 | A | * | 2/1986 | Wentzel | 160/232 |
| 4,569,383 | A | * | 2/1986 | Wentzel | 160/201 |
| 5,002,114 | A | * | 3/1991 | Hormann | 160/229.1 |
| 5,060,711 | A | * | 10/1991 | Fimbell, III | 160/229.1 |
| 5,168,915 | A | * | 12/1992 | Lafleur | 160/236 |
| 5,448,855 | A | * | 9/1995 | Sjoholm | 49/125 |
| 5,497,588 | A | | 3/1996 | Martin et al. | |
| 5,787,677 | A | | 8/1998 | Bolich et al. | |
| 6,578,619 | B2 | | 6/2003 | Wright | |

(Continued)

FOREIGN PATENT DOCUMENTS

| | | |
|---|---|---|
| BE | 402554 | 5/1934 |
| DE | 1659585 | 1/1971 |

(Continued)

OTHER PUBLICATIONS

Korean Application No. 10-2007-0050453, Office Action Summary mailed Mar. 5, 2008, with English translation (8 pages).

(Continued)

*Primary Examiner* — Branon Painter
(74) *Attorney, Agent, or Firm* — Christie, Parker & Hale, LLP

(57) ABSTRACT

A large opening rolling door of the articulating type has multiple horizontally and vertically distributed insulative glass panes supported by a plurality of vertically disposed and horizontally disposed heat transmitting metal frame members arranged in vertical and horizontal regions respectively between adjacent glass panes. The horizontal frame members have opposed and closed or open and recessed edge volumes in the closed condition of the door; preformed, self-supporting, self-camming and self-compressing and cooperating male and female insulator bands that interfit with the open and recessed edge volumes, or insulation filled beams, in the closed condition of the door define insulation in the horizontal regions. Vertical frame members define a substantially enclosed volume in which a preformed, self-supporting insulator band is inserted into the volume to insulate the vertical regions and thus substantially the entire door against heat transmission therethrough.

17 Claims, 7 Drawing Sheets

(56) References Cited

U.S. PATENT DOCUMENTS

| | | | | |
|---|---|---|---|---|
| 6,629,387 | B2 * | 10/2003 | Whitley et al. | 52/64 |
| 6,772,818 | B2 | 8/2004 | Whitley et al. | |
| 2006/0254730 | A1 * | 11/2006 | Wood | 160/236 |

FOREIGN PATENT DOCUMENTS

| | | |
|---|---|---|
| JP | 56-131790 | 10/1981 |
| JP | 59-17990 | 12/1984 |
| JP | 60-159190 | 10/1985 |
| JP | 5-58798 | 8/1993 |
| JP | 2002-242542 | 8/2002 |
| WO | WO 99/64710 | 12/1999 |

OTHER PUBLICATIONS

Japanese Patent Application Publication No. 05-58798 for Japanese Patent Application No. 1992-5388, with English abstract.

Korean Patent Application Publication No. 20-1997-052090 for Korean Application No. 20-1996-002925 with English abstract (7 pages).

Extended European Search Report for Application No. 07100280.2, transmission date Nov. 21, 2011 (search completed Jul. 27, 2011), 9 pages.

Japanese Final Office action issued for Japanese Patent Application No. 2007-081418, date of mailing Jul. 12, 2011, with English Translation, 23 pages.

* cited by examiner

FIG. 7
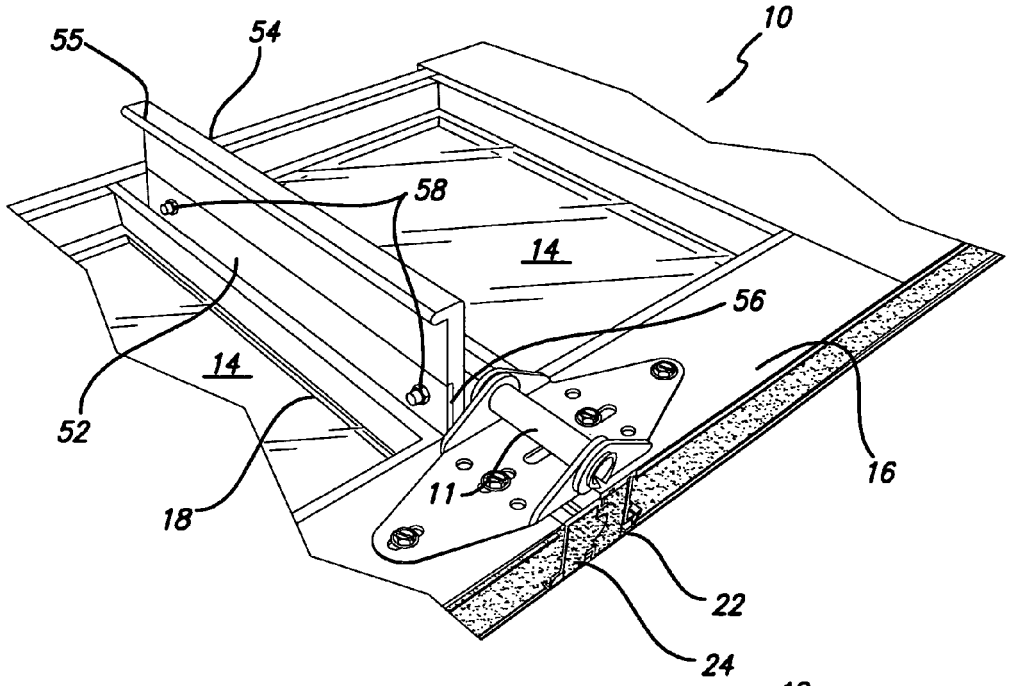
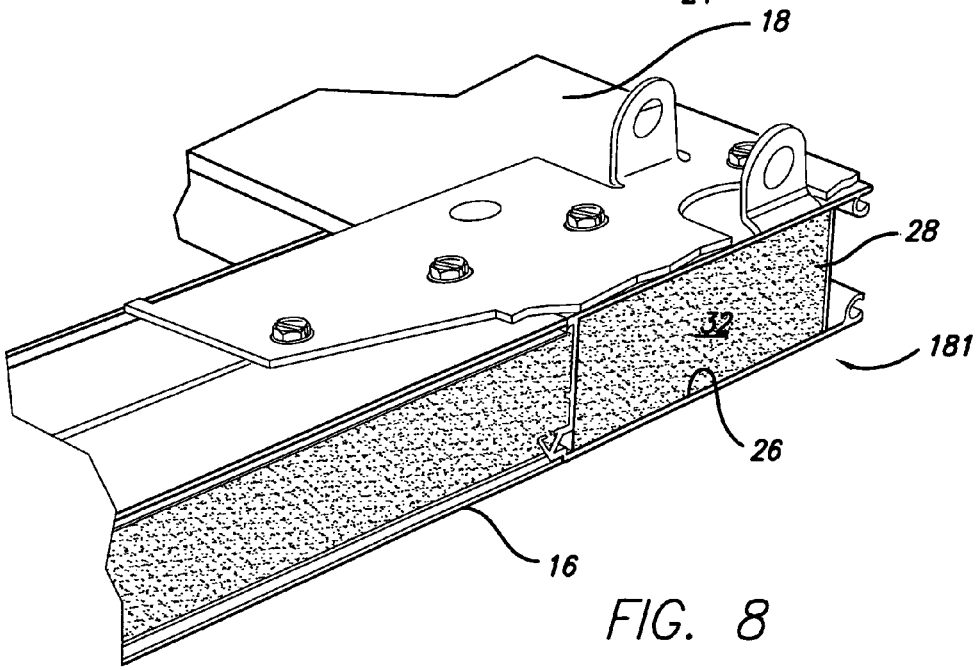
FIG. 8

FULLY INSULATED GLASS PANEL ROLLING DOOR

CROSS-REFERENCE TO RELATED APPLICATION(S)

This application claims the benefit of U.S. Provisional Application No. 60/808,203, filed May 24, 2006.

BACKGROUND OF THE INVENTION

This invention relates to rolling doors, including sectional overhead, carriage house type doors and others having single or multiple panels usually with light passing glass inserts, typically arranged to tilt or articulate across their widths so as to roll e.g. on wheel and track systems to and from a storage location overhead. Such doors are common in commercial settings such as service stations, fire houses, "Malibu" offices, and the like, but find application in conventional housing situations as garage doors and with light passing, typically glass, inserts as doors to living spaces and anywhere where a large opening is to be selectively closed while admitting light into the closed space.

DESCRIPTION OF RELATED ART

While tilting single panel and multisectioned rolling doors with glass lights are in widespread use, they are not energy efficient, even with thermally insulative panes in the door lights, owing to heat loss through the frame members, typically heat-conductive aluminum. Further they are generally not strong enough for high risk locations such as hurricane-prone sections of the country as they tend to fail to survive object impacts or buckle under positive and negative pressures encountered during violent windstorms.

SUMMARY OF THE INVENTION

It is an object therefore to provide a better single section or multiple section rolling door. It is a further object to provide a rolling door in which thermally insulative glass panes are used to limit heat transfer and the normally heat-transmissive vertical and horizontal glass-supportive frame members are also insulated in the vertical and horizontal regions between the adjacent glass panels. A further object includes incorporating insulative material wherever significant heat loss can occur, e.g. in the frame members and configuring the insulative material so incorporated to both effect a good interfitting and self-compressing seal and remain in its mounting location despite expected and unexpected door movements, e.g. by preforming a self-supporting insulative material into a contour that will interfit with the openings, recesses and hollow edge faces and edge volumes in the frame members. A further object is to provide for the horizontal frame members having their edge volumes comprised of opposed and recessed open or closed edge faces in the closed condition of the door, in-situ or preformed, self-supporting and cooperating e.g. male and female insulator bands that interfit with the recessed edge faces in the closed condition of the door in insulation defining relation in the horizontal regions whereby the door, in its panes and the horizontal frame members, is insulated against heat transmission therethrough. A further object is the provision of specially profiled flange stiffeners across the door width against buckling and other distortions under wind forces or debris impacts.

These and other objects of the invention to become apparent hereinafter are realized in a large opening door having multiple horizontally and vertically distributed insulative glass panes supported by a plurality of vertical disposed and horizontally disposed heat transmitting metal frame members arranged in vertical and horizontal regions respectively between adjacent glass panes, the horizontal frame members having opposed edge volumes in the closed condition of the door, and insulator bands within the recessed edge volumes in the closed condition of the door cooperating in the closed condition of the door in insulation defining relation in the horizontal regions, whereby the door, in its panes and horizontal frame members, is insulated against heat transmission therethrough.

In this and like embodiments, typically, the vertical frame members define a substantially enclosed volume, an insulator band is provided within the vertical member volume in insulation defining relation, whereby the door, in its panes, horizontal frame members and vertical frame members, is insulated against heat transmission therethrough. The door is substantially rectangular and articulating, said horizontal frame members having opposed edge volumes are angularly separable for door articulation, the horizontal and vertical frame members define a grid having row and column apertures, glass panes are fitted into said apertures, and the horizontal frame members comprise beams defining the edge volumes, the frame members are made of aluminum, and the insulator bands comprise an insulative plastic structure.

In a further embodiment, the invention provides a large opening door of the single-section panel tilt-type or multisectioned panel and articulating type adapted to roll into and out of storage and having multiple horizontally and vertically distributed insulative glass panes supported by a plurality of vertically disposed and horizontally disposed heat transmitting metal frame members arranged in vertical and horizontal regions respectively between adjacent glass panes, wherein the edge volumes in the metal frame members in both the vertical and horizontal regions are insulation-filled, suitably under an insulation defining cooperating abutment, such as a camming compression that abuts the cooperating insulation bands in a camming action ensuring a full closure of the edge volumes. Typically, the horizontal frame members have their edge volumes comprised of opposed and recessed open edge faces in the closed condition of the door, filled with preformed, self-supporting and cooperating e.g. male and female insulator bands that interfit in compressed relation with the recessed edge faces in the closed condition of the door in insulation defining relation in the horizontal regions whereby the door in its the panes and the horizontal frame members is insulated against heat transmission therethrough.

In this and like embodiments, typically, the vertical frame members define an edge volume, and an insulator band is formed or preformed and inserted within the edge volume in insulation defining relation, whereby the door, in its panes, the horizontal frame members and the vertical frame members, is insulated against heat transmission therethrough.

Further, typically, the door is substantially rectangular, the horizontal and vertical frame members define a grid having row and column apertures, and the glass panes are fitted into the apertures, the frame members are made of aluminum, the insulator bands comprise an insulative structure, e.g. a solid, porous, layered, uniform or particulate mass such as a multiple void defining mass of mineral, plastic or cellulosic particles, webs, fibers or other structures offering thermal insulation in an insulative structure that is exposed or closed within the edge volumes, the insulator bands when interfitting comprise cooperating male and female structures, the male structures each having an elongated body that substantially fills and engages one of the opposed recessed edge faces of the edge volumes, shoulders extending in a plane, and an oversized protuberant center portion extending beyond the shoulder plane and the opposed recessed edge faces, the female structures each having an elongated body that substantially fills and engages the other of the opposed recessed edge faces of the edge volumes, shoulders extending in a plane, and a recessive center portion below the shoulder plane, the male and female structure shoulder planes abutting, the recessive center portion being shaped to receive in camming and compressing relation the male structure protuberant center in the abutting condition of the male and female structure shoulder planes in insulative relation, whereby the insulative structures are self-camming, self-aligning, self-compressing and self-sealing when the door is in its closed condition, the insulative structure comprises a mineral material, such as glass or mineral fiber, cellulosic materials such a paper, a plastic material such as sprayed-in, preformed, particulate and/or expanded, blown or foamed or solid synthetic organic plastics, including polyolefins such as polyethylenes, polypropylenes, polystyrenes and copolymers thereof, and polyurethanes, and the glass pane comprises first and second glass pane panels supported in a frame in insulative space defining relation between the pane panels.

In a further embodiment, the invention provides a large opening rolling door of the articulating type having multiple horizontally and vertically distributed insulative glass panes supported by a plurality of vertically disposed and horizontally disposed heat transmitting metal frame members arranged in vertical and horizontal regions respectively between adjacent glass panes, the horizontal frame members having opposed edge volumes within recessed edge faces in the closed condition of the door, cooperating male and female insulator bands that rearwardly interfit suitably in compressed relation with the recessed edge faces in the closed condition of the door in insulation defining relation in the horizontal regions and forwardly interfit with each other in camming and self-compressing relation, the vertical frame members defining a substantially enclosed edge volume, and an insulator band within the edge volume in insulation defining relation, whereby the door in its panes, the horizontal frame members and the vertical frame members is insulated against heat transmission therethrough, the interfittment of the cooperating male and female insulator bands is such that the bands are self-camming, self-aligning and self-sealing through mutual compression when the door is in its closed condition.

In a further embodiment, the invention provides a large opening rolling door of the articulating type having multiple horizontally and vertically distributed insulative glass panes supported by a plurality of vertically disposed and horizontally disposed heat transmitting metal frame members arranged in vertical and horizontal regions respectively between adjacent glass panes, the horizontal frame members having opposed and recessed edge faces in the closed condition of the door, preformed, self-supporting and cooperating male and female insulator bands that rearwardly interfit with the recessed edge faces in the closed condition of the door in insulation defining relation in the horizontal regions and forwardly interfit with each other, the vertical frame members defining a substantially enclosed volume, and an insulator band within the volume in insulation defining relation, whereby the door in its panes, horizontal frame members and vertical frame members is insulated against heat transmission therethrough.

In this and like embodiments, typically, the interfittment of the cooperating male and female insulator bands is such that the bands are self-camming, self-aligning, self-compressing, and self-sealing when the door is in its closed condition, at least one of the recessed edge faces has a lateral shoulder flange projecting into the recessed edge face and a vertically disposed rib, the lateral shoulder flange blocking exit of the insulator band within the recessed edge face, the rib engaging the band against vertical dislodgement from the recessed edge face, or the recessed edge faces each have a lateral shoulder flange projecting into the recessed edge face and a vertically disposed rib, the lateral shoulder flange blocking exit of the insulator bands from within their respective recessed edge faces, the ribs being oppositely directed and engaging respective ones of the bands against vertical dislodgement from their respective recessed edge faces, the door is substantially rectangular, the horizontal and vertical frame members define a grid having row and column apertures, and the glass panes are fitted into the apertures, the frame members are made of aluminum, the insulator bands comprise an insulative structure, the insulator bands comprise cooperating male and female structures, the male structures each having an elongated body that substantially fills and engages one of the opposed recessed edge faces, shoulders extending in a plane, and a protuberant center portion extending beyond the shoulder plane and the opposed recessed edge faces, the female structures each having an elongated body that substantially fills and engages the other of the opposed recessed edge faces, shoulders extending in a plane, and a recessive center portion below the shoulder plane, the male and female structure shoulder planes abutting, the recessive center portion being shaped to receive the male structure protuberant center in the abutting condition of the male and female structure shoulder planes in center portion mutually compressing and insulative relation, the insulative structure comprises a plastic, and the glass pane comprises first and second glass pane panels supported in a frame in insulative space defining relation between the pane panels. Although the door can be rectangular, other shapes are contemplated such as square, trapezoidal or other geometric configurations.

In a further, specific embodiment, the invention provides a large opening rectangular rolling door of the articulating type having a plurality of vertically disposed and horizontally disposed heat transmitting aluminum metal frame members defining a grid having row and column apertures, multiple horizontally and vertically distributed insulative glass panes fitted into the apertures, the glass panes comprising first and second glass pane panels supported in a frame in insulative space defining relation between the pane members, the vertically disposed and horizontally disposed frame members defining vertical and horizontal regions respectively between adjacent glass panes, the horizontal frame members having opposed and recessed edge faces in the closed condition of the door, preformed, self-supporting and cooperating male and female cellular insulator structures, the male structures each having an elongated body that substantially fills and engages one of the opposed recessed edge faces, shoulders extending in a plane, and a protuberant center portion extending beyond the shoulder plane and the opposed recessed edge faces, the female structures each having an elongated body that substantially fills the other of the opposed recessed edge faces, extending in a plane and that engage the other one of the opposed recessed edge faces, and a recessive center portion below the shoulder plane, the male and female structure shoulder planes abutting in the closed condition of the door, the recessive center portion being shaped to receive in compressing relation the male structure protuberant center in the abutting condition of the male and female structure shoulder planes in insulative relation in insulation defining relation in the horizontal regions, the vertical frame members defining a substantially enclosed volume, and a preformed, self-supporting plastic foam insulator band within the volume in insulation defining relation, whereby the door in its the panes, the horizontal frame members and the vertical frame members is insulated against heat transmission therethrough, there is further provided in some embodiments a rearwardly projecting flange on a horizontal frame member of a thickness and horizontal extent only minorly reinforcing the door against buckling under wind and wind-blown debris, and a flange extension of the projecting flange of a substantially greater thickness and horizontal extent, the flange extension being partially relieved to receive the thickness of the projecting flange and attached to the projecting flange.

In a further embodiment, the invention provides a large opening rolling door of the articulating type having multiple horizontally and vertically distributed insulative glass panes supported by a plurality of vertically disposed and horizontally disposed heat transmitting metal frame members arranged in vertical and horizontal regions respectively between adjacent glass panes, the horizontal frame members having opposed and recessed edge faces in the closed condition of the door, a rearwardly projecting flange on a horizontal frame member of a thickness and horizontal extent only minorly reinforcing the door against buckling under wind and wind-blown debris, and a flange extension of the projecting flange of a substantially greater thickness and horizontal extent, the flange extension being partially relieved to receive the thickness of the projecting flange and attached to the projecting flange, preformed, self-supporting and cooperating male and female insulator bands that interfit with the recessed edge faces in the closed condition of the door in insulation defining relation in the horizontal regions, the vertical frame members defining a substantially enclosed volume, and an insulator band within the volume in insulation defining relation, whereby the door in its panes, horizontal frame members and vertical frame members is insulated against heat transmission therethrough.

In a further embodiment, the invention provides a large opening rolling door of the articulating type having multiple horizontally and vertically distributed insulative glass panes supported by a plurality of vertically disposed and horizontally disposed heat transmitting metal frame members arranged in vertical and horizontal regions respectively between adjacent glass panes, the horizontal frame members having opposed and recessed edge faces in the closed condition of the door, insulative bands blocking heat transmission through said regions, and a rearwardly projecting flange on a horizontal frame member of a thickness and horizontal extent only minorly reinforcing the door against buckling under wind and wind-blown debris, and a flange extension of the projecting flange of a substantially greater thickness and horizontal extent attached to the projecting flange.

In its method aspects, the invention provides a method of insulatively closing a large opening including disposing within the opening a rolling door, e.g. of the articulating multi-sectioned type, and insulating the door with multiple horizontally and vertically distributed insulative glass panes supported by a plurality of vertically disposed and horizontally disposed heat transmitting metal frame members arranged in vertical and horizontal regions respectively between adjacent glass panes, the horizontal frame members having opposed edge volumes such as recessed edge faces in the closed condition of the door, insulating the vertical regions with insulative bands such as those within a closed figure edge volume, and those that are preformed, self-supporting, self-camming, self-compressing and cooperating male and female insulator bands that interfit with the recessed edge faces in the closed condition of the door in insulation defining relation in the horizontal regions, the vertical frame members defining a substantially enclosed volume, and insulating the vertical regions with an insulator band within the volume in insulation defining relation, whereby to insulate the door in its panes, the horizontal frame members and the vertical frame members against heat transmission therethrough.

BRIEF DESCRIPTION OF THE DRAWINGS

The invention will be further described in conjunction with the attached drawings in which:

FIG. 7 is a fragmentary detail view taken on line 7 in FIG. 1, showing the invention door with a stiffening flange and attached flange extension against extreme conditions such as hurricane force winds and flying debris, vertical and horizontal member insulation in place; and FIG. 8 is a fragmentary view of a portion of the door showing the vertical and horizontal member insulation in place.

DETAILED DESCRIPTION OF THE INVENTION

Figure 4A:
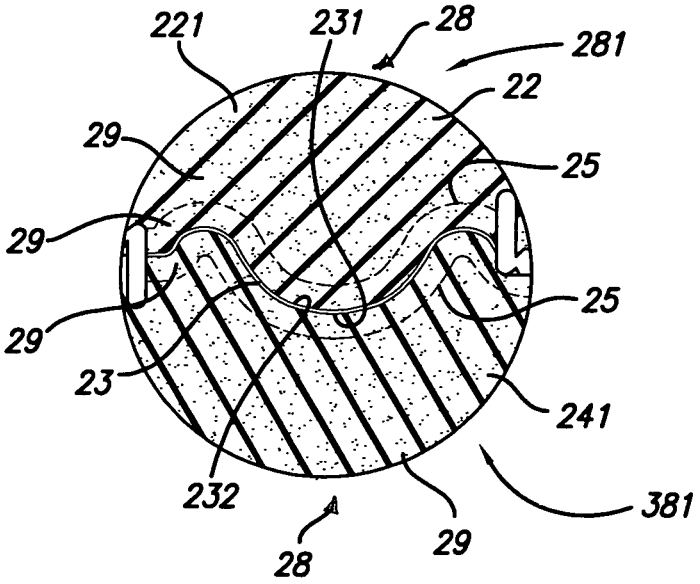
FIG. 4A is a detail view taken on line 4A in FIG. 4.
Figure 4:
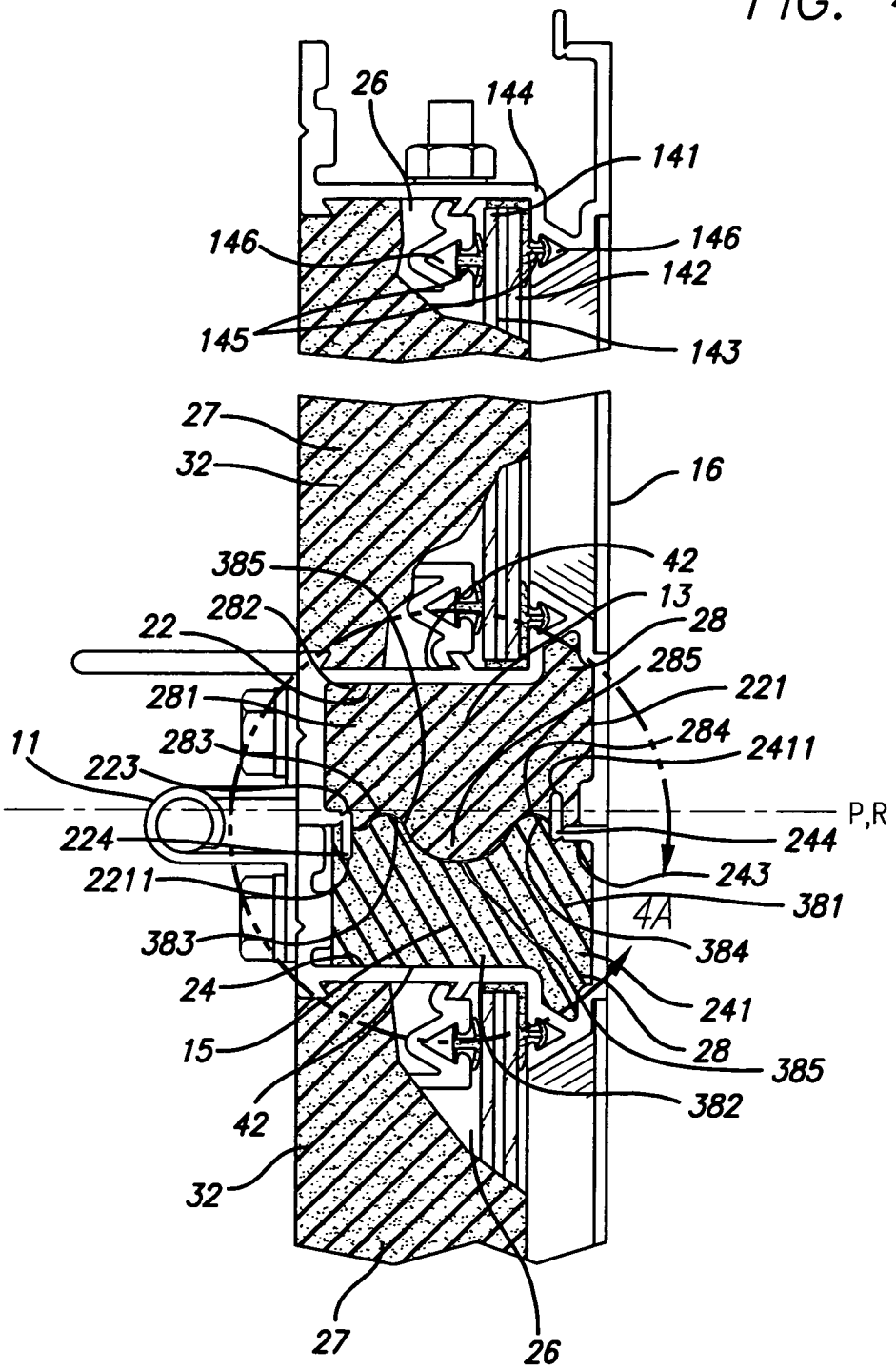
FIG. 4 is a fragmentary vertical section, enlarged, showing horizontal frame member insulation of the interfitted type, taken on line 4-4 in FIG. 2.
Figure 5:
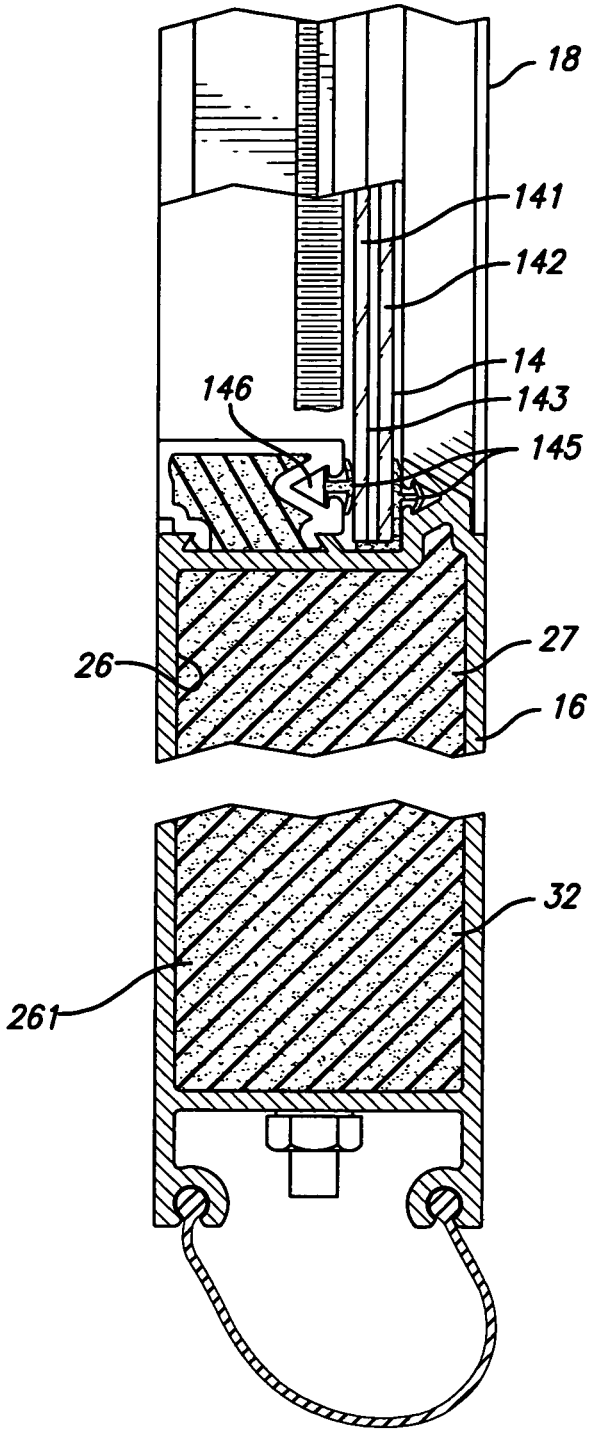
FIG. 5 is a fragmentary detail view, enlarged of a vertical frame member insulation taken on line 5-5 in FIG. 2.
Figure 6:
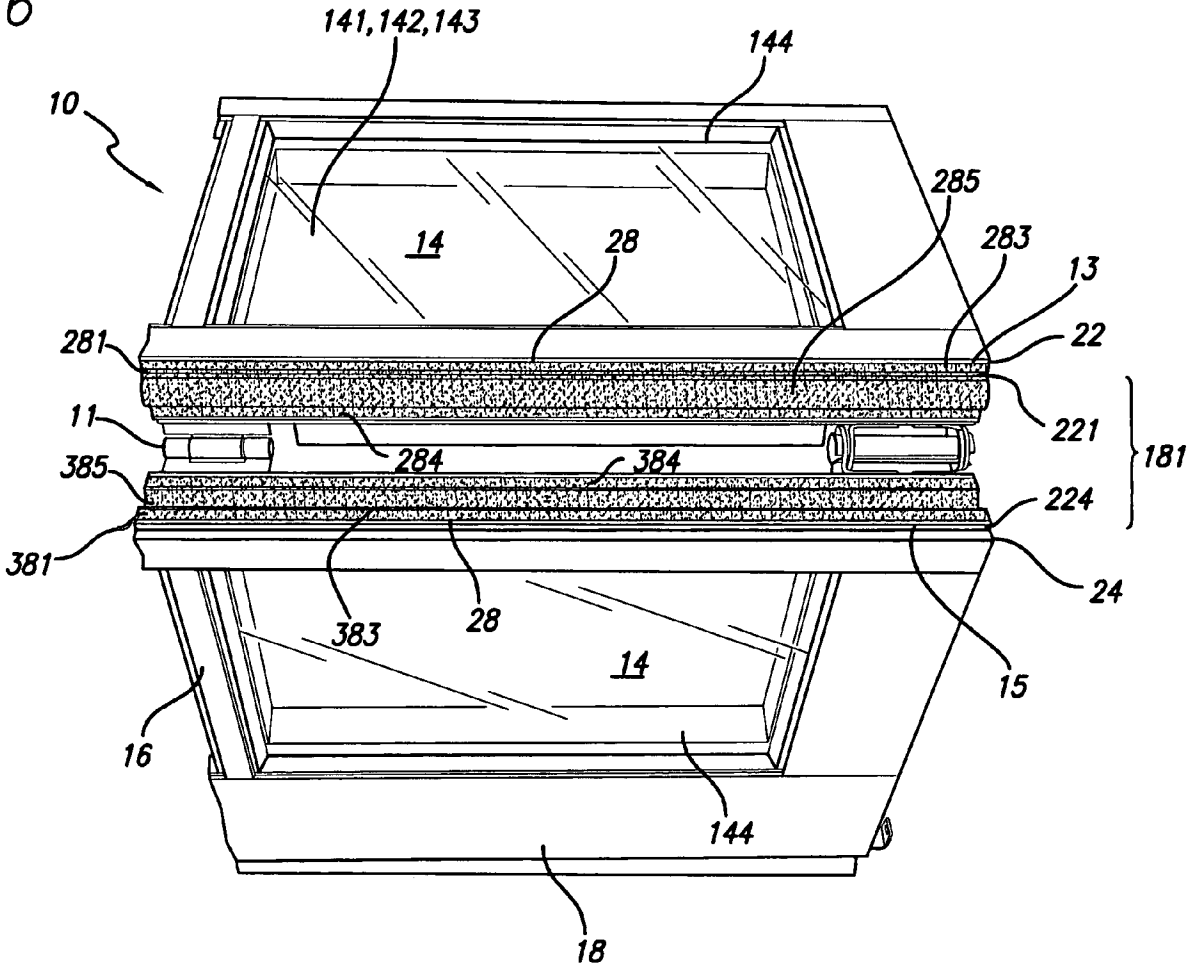
FIG. 6 is an oblique view of a door assembly showing the horizontal frame member insulation in place.

With reference now to the drawings in detail, in FIGS. 1-8, a door 10 is provided for a large opening 12; the door can be a single panel tilt type or multi-sectioned panel of the articulating type, shown in FIG. 6, which is periodically hinged at 11 across its width and has multiple horizontally and vertically distributed insulative glass panes 14, e.g. dual pane panels 141, 142 with a vacuum or gas-filled insulative space 143 therebetween (FIG. 5). Panes 14 are sealed to vertical frame member 16 and cushioned by elongated, somewhat dumb-bell-shaped in cross-section plastic, e.g. polyvinyl chloride i.e. vinyl, strips 145 held in pockets 146 formed in extruded vertical frame member. Pockets 146 can be insulated as well with insulation material 26. The panes 14 are supported by a plurality of vertically disposed and horizontally disposed heat transmitting metal frame members 16 (vertical), 18 (horizontal) arranged in vertical regions 161 and horizontal regions 181, respectively, of the door 10 to be between adjacent glass panes 14. Open edge volumes 13, 15 are defined by recessed edge faces 22, 24 (FIGS. 1-8), respectively, in the horizontal metal frame members 18, providing the horizontal regions 161 that are substantially filled, e.g. to 95% or more with insulation bands 221, 241. In the illustrated embodiment vertical members 16 defining vertical regions 161 have an interior volume 26 that is substantially insulation-filled, to 95% or more by volume by insulation bands 27.

In the FIGS. 1-8 embodiment, the insulation bands 221, 241 are suitably shaped to be under an insulation defining cooperating abutment such as a camming compression at their junction 23 to provide zones 25 of relatively compressed insulative material 29 at the meeting faces 231, 232 of the insulation bands to ensure full closure of the edge volumes 13, 15 and a thermally tight interface at junction 23. As best shown in FIG. 4A the insulation band 221, 241 contact line is at junction 23 between the faces 231, 232 of the insulation bands, with the compression effect shown in higher compression zones 25 inward of the faces.

More particularly in the FIG. 1-8 embodiments, the horizontal frame members 18 have recessed edge faces 22, 24, defining open edge volumes 13, 15, that are opposed in the closed condition of the door as shown e.g. in FIG. 4. Within recessed edge faces 22, 24 are the preformed, self-supporting and cooperating, e.g. male and female, insulator bands 221, 241, respectively, that interfit in compressed relation with the recessed edge faces in the closed condition of the door 10 in insulation defining relation in the horizontal regions 181. Door 10 is thus insulated against heat transmission through its panes or through the horizontal frame members 18.

Vertical frame members 16 define the substantially enclosed edge volume 26; insulator band 27, typically an elongated block 32 of e.g. cellular polystyrene, that is formed in or inserted into volume 26 in insulation defining relation. With the insulator band 27 in place, the door 10 is in its panes 14, horizontal frame members 18 and vertical frame members 16 insulated against heat transmission therethrough.

Typically the door 10 is substantially rectangular as shown; vertical and horizontal frame members 16, 18 define a grid 34 having row and column apertures 341, 342 with the glass panes 14 fitted into the apertures. Generally the frame members 16, 18 are made of aluminum, but wood and other materials of sufficient strength and durability such as steel can be used.

The interfitting insulator bands 221, 241 each comprise an insulative structure 28, e.g. a solid, porous, layered, uniform or particulate mass such as a multiple void defining mass of mineral, plastic or cellulosic particles, webs, fibers or other structures offering thermal insulation in an insulative structure that is exposed or closed within the edge volumes 13, 15. Insulator bands 221, 241 comprise cooperating male and female structures 281, 381, respectively. Male structures 281 each have an elongated body 282 that substantially fills and engages one of the opposed recessed edge faces 22 of the open edge volumes 13, 15. Body shoulders 283, 284 extend in a plane P, R while male structure elongated body 282 engages one of the recessed edge faces, edge face 22 of the edge volume 13. Body protuberant center portion 285 is oversized and extends beyond the shoulder plane P, R and the engaged recessed edge faces 22.

The female structures 381 each have an elongated body 382 that substantially fills and engages the other of the opposed recessed edge faces 24 of the edge volumes 13, 15, its shoulders 383, 384 extending in the plane P, R parallel and nearly coincident with plane P, R in the closed condition of door 10. Female elongated body 382 fills and engages the other one of the opposed recessed edge faces, i.e. edge face 24. Female structure body 382 further has a recessive center portion 385 generally congruent with male structure protuberant center 285 and located below the shoulder plane R-R. The congruency of the recessive center portion 385 and protuberant center portion 285 ensure that these portions cam slide on each other, thus centering the latter into the former by a self-camming action. Male and female shoulders generally abut as shown. Recessive center portion 385 is shaped as shown to receive in camming and compressing relation the male structure protuberant center 285 in the abutting condition of the male and female shoulders in insulative relation in the closed condition of the door 10. As best shown in FIGS. 4A and 7, the insulative structures 281, 381 are arranged as shown to be self-camming, self-aligning, self-compressing and self-sealing when the door 10 is in its closed condition. That is, the insulative structures 281, 381 further are pressed together upon the door being shifted to a closed condition, such that the insulation body zones 25 immediately inward of the faces 231, 232 are relatively compressed, e.g. from 3 to 12% by volume, further ensuring a thermally tight sealing between the structures 281, 381.

In general, the insulative structures 281, 381 (and band 27 as applicable) comprise, e.g. a mineral material, such as glass or mineral fiber, beads or other shape providing insulation affording voids in the structures, cellulosic materials such as paper, a plastic material such as sprayed-in, preformed, particulate and/or expanded, blown, foamed or solid synthetic organic plastics, including polyolefins such as polyethylenes, polypropylenes, polystyrenes and copolymers thereof, and polyurethanes in a solid, porous, layered, uniform or particulate mass such as a multiple void defining mass of mineral, plastic or cellulosic particles, webs, fibers or other structures such as and particularly expanded sintered polystyrene beads or other polystyrene foamed or cellular materials that offer thermal insulation in an insulative structure that is exposed in edge volumes 13, 15 or closed within the edge volumes that afford insulative properties per se or through cellular, void-defining structure. The glass pane 14 comprises first and second glass (or plastic) pane panels 141, 142 supported in a frame 144 in dead air/gas-filled insulative space 143-defining relation between the pane panels.

Further, the invention provides a large opening rolling door 10 of the articulating type having multiple horizontally and vertically distributed insulative glass panes 14 supported by a plurality of vertically disposed and horizontally disposed heat transmitting metal frame members 16, 18 arranged in vertical and horizontal regions 161, 181 respectively between adjacent glass panes.

The horizontal frame members 18 have opposed open edge volumes 13, 15 within recessed edge faces 22, 24 in the closed condition of the door 10. Preformed, self-supporting, self-camming and self-compressing and cooperating male and female insulator bands 221, 241 rearwardly interfit, at 42, in compressed relation with the recessed edge faces 22, 24 in the closed condition of the door in insulation defining relation in the horizontal regions 181; the insulator bands forwardly interfit in camming, self-compressing and nesting relation with each other, as shown, in FIGS. 4, 4A and 7. The vertical frame members 16 define a substantially enclosed edge volume 26; an insulator band 261 is provided within the volume in insulation defining relation, whereby the door 10 in its panes 14, its horizontal frame members 18 and its vertical frame members 16 is insulated against heat transmission therethrough. As in the previous embodiment, the interfittment of the cooperating male and female insulator bands 221, 241 is such that the bands are self-camming, self-aligning and self-sealing through mutual compression when the door 10 is in its closed condition.

Further, in these and other embodiments herein and as best shown in FIG. 4, recessed edge faces 22, 24 have laterally projecting (into the faces) shoulder flanges 223, 243 that interlock with insulator bands 221, 241 to block exit of the bands from their recessed edge faces. Recessed edge faces 22, 24 further define oppositely directed vertical ribs 224, 244 that in the closed condition of the door 10 engage the outer surfaces 2211 and 2411 of the insulator bands 221, 241 in locking relation against their dislodgement from the recessed edge faces.

Figure 1:
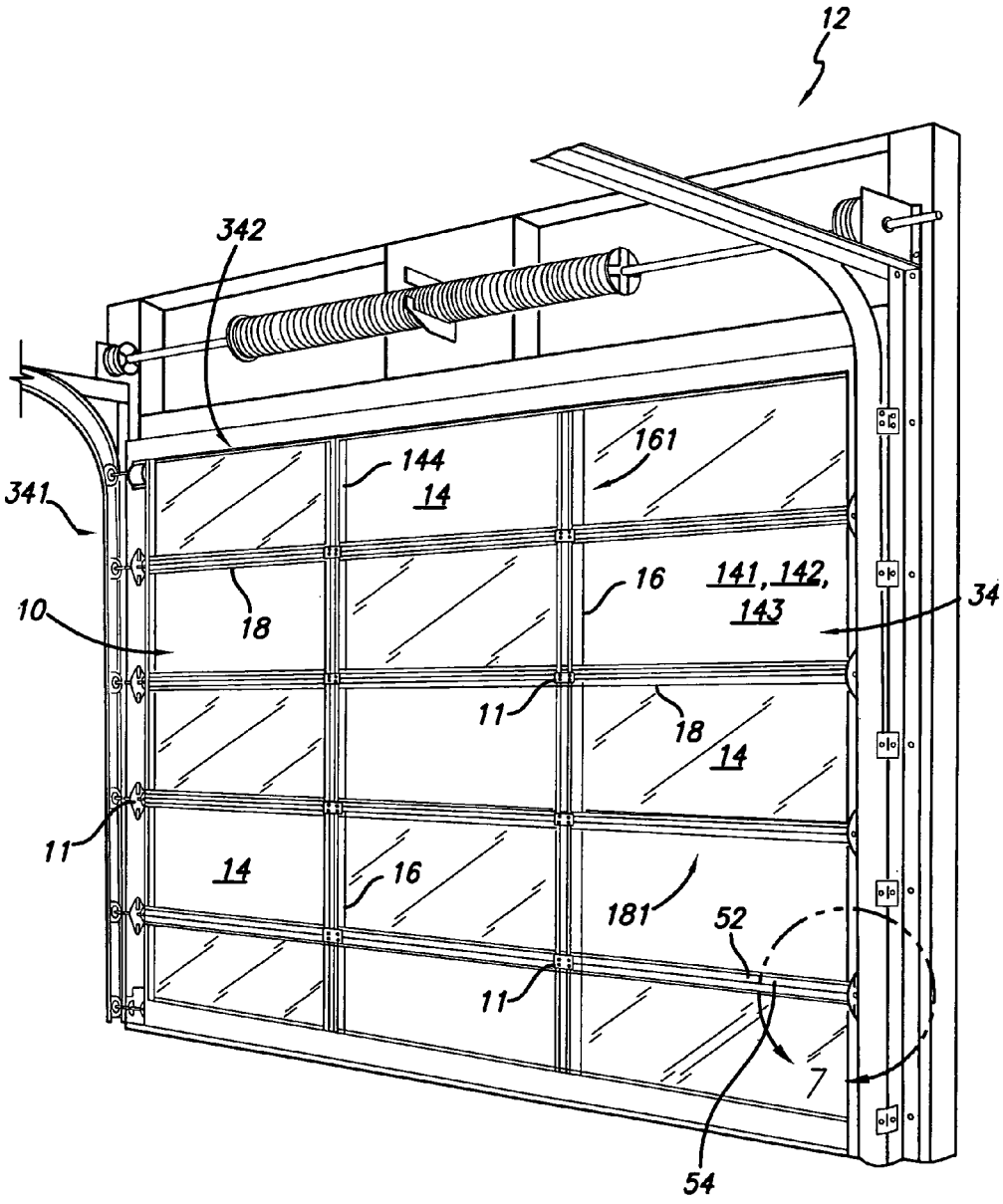
FIG. 1 is an oblique rear view of a large opening door according to the invention.
Figure 3:
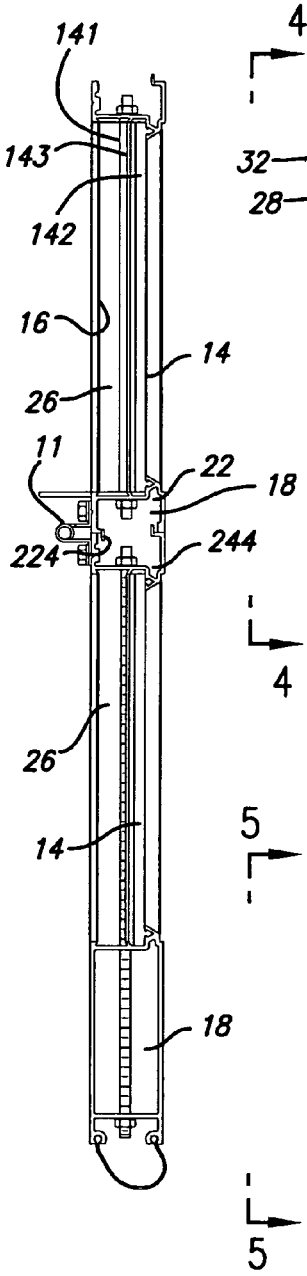
FIG. 3 is a vertical section of a door before insertion of frame member insulation.
Figure 2:
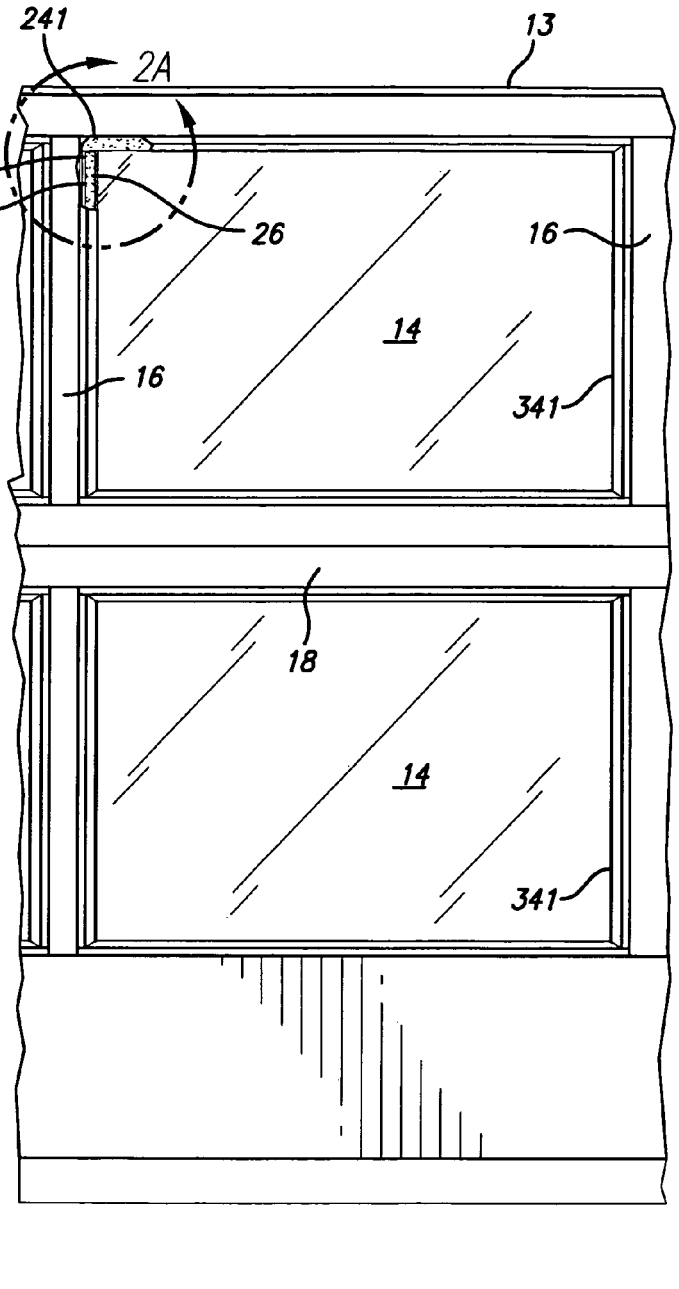
FIG. 2 is a fragmentary front elevation view thereof.
Figure 2A:
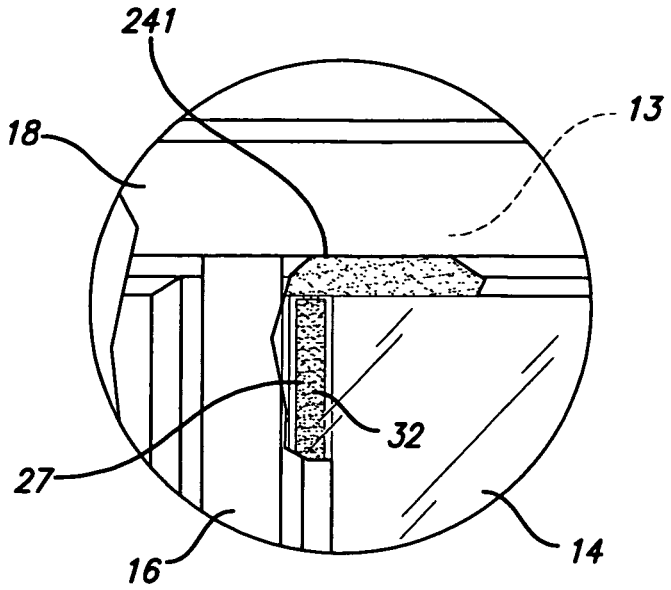
FIG. 2A is a detail view taken on line 2A in FIG. 2.

In a further aspect of the invention, and with particular reference to FIGS. 1 and 7, there is further provided in some embodiments of the invention a rearwardly projecting flange 52 on one or more of the horizontal frame members 18 of a thickness and horizontal extent only minorly reinforcing the door 10 against buckling under wind and wind-blown debris. A flange extension 54 having a rounded edge flange 55 is provided on the projecting flange 52 at a substantially greater thickness and horizontal extent, as shown in FIG. 7. Flange extension 54 is partially relieved at 56 to receive the thickness of the projecting flange 52; the extension being attached to the projecting flange by bolts 58, welding, or other means.

Thus, in a further embodiment, best shown in FIGS. 1 and 7, the invention provides a large opening rolling door 10 of the articulating type having multiple horizontally and vertically distributed insulative glass panes 14 supported by a plurality of vertically disposed and horizontally disposed heat transmitting metal frame members 16, 18 arranged in vertical and horizontal regions 161, 181, respectively between adjacent glass panes, the horizontal frame members having opposed and recessed edge faces 22, 24 in the closed condition of the door, a rearwardly (inward in the mounted condition of the door 10) projecting flange 52 on a horizontal frame member 18 of a thickness and horizontal extent only minorly reinforcing (i.e. insufficiently reinforcing for 100 mph plus winds and heavy flying debris) the door against buckling under wind and wind-blown debris, and a flange extension 54 of the projecting flange of a substantially greater thickness and horizontal extent, as shown, the flange extension being partially relieved at 56 to receive the thickness of the projecting flange to which the extension flange is attached by bolts 58 or other fastening expedient, preformed, self-supporting and cooperating male and female insulator bands 221, 241 are positively locked into their respective recessed edge faces 22, 24.

Further in the closed condition of the door 10 bands 221, 241 extend in insulation defining relation in the horizontal region 181; the vertical frame members defining a substantially enclosed volume 26, and an insulator band 261 in region 161 within and substantially filling the volume in insulation defining relation, whereby the door in its panes, horizontal frame members and vertical frame members is insulated against heat transmission therethrough.

In its method aspects, the invention provides a method of insulatively closing a large opening 12 including disposing within the opening a rolling door 10, and insulating the door with multiple horizontally and vertically distributed insulative glass panes 14 supported by a plurality of vertically disposed and horizontally disposed heat transmitting metal frame members 16, 18 arranged in vertical and horizontal regions 161, 181 respectively, between adjacent glass panes, the horizontal frame members having opposed and recessed edge volumes such as edge volumes 13, 15 and recessed edge faces 22, 24, in the closed condition of the door, insulating the horizontal regions with insulative bands 221, 241 such as those within the edge volumes that are preformed, self-supporting, self-camming, self-compressing and cooperating male and female insulative bands that interfit with the recessed edge faces in the closed condition of the door in insulation defining relation in the horizontal regions, the vertical frame members defining a substantially enclosed volume 26, and insulating the vertical regions with insulative structures 27, e.g. an insulator band 261 within the volume in insulation defining relation, whereby to insulate the door in its panes, its horizontal frame members and its vertical frame members against heat transmission therethrough.

The invention thus provides a better single section or multiple section rolling door in which thermally insulative glass panes are used to limit heat transfer and the normally heat-transmissive vertical and horizontal glass-supportive metal frame members are also insulated in the vertical and horizontal regions between the adjacent glass panels, by incorporating insulative material wherever significant heat loss can occur, e.g. in the frame members and configuring the insulative material so incorporated to both effect a good interfitting and self-compressing or closed seal and remain in its mounting location despite expected and unexpected door movements by preforming self-supporting insulative material into a contour that will interfit with the openings, recesses and hollow edge volumes in the frame members that have their edge volumes comprised of opposed open or closed edge faces in the closed condition of the door either in-situ or as self-supporting and cooperating e.g. male and female insulator bands that interfit with the recessed edge volumes and faces in the closed condition of the door in insulation defining relation in the horizontal regions, whereby the door in its the panes and the horizontal frame members against heat transmission therethrough, or conforming insulator bands within closed figure horizontal and vertical edge volumes. Stiffeners are also provided across the door width against buckling and other distortions under wind forces or debris impacts.

What is claimed is:

1. A large opening door having multiple horizontally and vertically distributed insulative glass panes supported by a plurality of vertical disposed and horizontally disposed heat transmitting metal frame members arranged in vertical and horizontal regions respectively between adjacent glass panes, said vertical frame members defining an enclosed volume containing an insulator band, said horizontal frame members having opposed edge volumes in the closed condition of the door, and insulator bands within said opposed edge volumes cooperating in the closed condition of the door in insulation defining relation in said horizontal regions, whereby said door, in its said panes, said vertical frame members, and said horizontal frame members, is fully insulated against heat transmission therethrough, whereby the insulator band in the vertical frame member and the insulator bands only within the opposed edge volumes of the horizontal frame members fill the entire enclosed volume and opposed edge volumes and are an insulation material made of a solid, porous, layered, uniform, or particulate mass of mineral, plastic or cellulosic materials, webs, or fibers.

2. The large opening door according to claim 1, in which said frame members are made of aluminum.

3. The large opening door according to claim 1, in which said insulator bands comprise an insulative plastic structure.

4. The large opening door according to claim 1, in which at least one of said horizontal frame members has a lateral shoulder flange and a vertically disposed rib, said lateral shoulder flange blocking exit of the insulator band within said opposed edge volume, said rib engaging said band against vertical dislodgement from said opposed edge volume.

5. A large opening door having multiple horizontally and vertically distributed insulative glass panes supported by a plurality of vertically disposed and horizontally disposed heat transmitting metal frame members arranged in vertical and horizontal regions respectively between adjacent glass panes, said vertical frame members defining an enclosed volume, and an insulator band within said volume in insulation defining relation, said horizontal frame members having opposed and recessed edge faces in the closed condition of the door, and preformed, self-supporting and cooperating male and female insulator bands that interfit only within said recessed edge faces in the closed condition of the door in insulation defining relation in said horizontal regions whereby said door, in its said panes, said horizontal frame members, and vertical frame members, is fully insulated against heat transmission therethrough, whereby said insulation defining relation of the insulator band and the insulator bands is by filling the entire enclosed volume of the vertical frame members and the recessed edge faces of the horizontal frame members and is an insulation material made of a solid, porous, layered, uniform, or particulate mass of mineral, plastic or cellulosic particles, webs, or fibers.

6. The large opening door according to claim 5, in which said frame members are made of aluminum.

7. The large opening door according to claim 5, in which said insulator bands comprise an insulative plastic structure.

8. The large opening door according to claim 5, in which said insulator bands comprise cooperating male and female structures, said male structures each having an elongated body that fills and engages one of said opposed recessed edge faces, shoulders extending in a plane, and a protuberant center portion extending beyond said shoulder plane and said recessed edge faces, said female structures each having an elongated body that fills and engages the other of said opposed recessed edge faces, shoulders extending in a plane, and a recessive center portion below said shoulder plane, said male and female structure shoulder planes abutting, said recessive center portion being shaped to receive said male structure protuberant center in the abutting condition of said male and female structure shoulder planes in insulative relation, whereby the insulative plastic structures are self-camming, self-aligning and self-sealing when the door is in its closed condition.

9. The large opening door according to claim 8, in which said insulative plastic structure comprises a urethane plastic.

10. The large opening door according to claim 5, in which said glass pane comprises first and second glass pane panels supported in a frame in insulative space defining relation between said pane panels.

11. A large opening rectangular rolling door of the articulating type having a plurality of vertically disposed and horizontally disposed heat transmitting aluminum metal frame members defining a grid having row and column apertures, multiple horizontally and vertically distributed insulative glass panes fitted into said apertures, said glass panes comprising first and second glass pane panels supported in a frame in insulative space defining relation between said pane panels, said vertically disposed and horizontally disposed frame members defining vertical and horizontal regions respectively between adjacent glass panes, said horizontal frame members having opposed and recessed edge faces in the closed condition of the door, preformed, self-supporting and cooperating male and female plastic foam insulator structures, said male structures each having an elongated body that fills and engages an entire area one of said opposed recessed edge faces, shoulders extending in a plane, and a protuberant center portion extending beyond said shoulder plane and said opposed recessed edge faces, said female structures each having an elongated body that fills and engages an entire area the other of said opposed recessed edge faces, shoulders extending in a plane, and a recessive center portion below said shoulder plane, said male and female structure shoulder planes abutting in the closed condition of said door, said recessive center portion being shaped to receive said male structure protuberant center in the abutting condition of said male and female structure shoulder planes in insulation defining relation in said horizontal regions, said vertical frame members defining an enclosed volume, and a preformed, self-supporting plastic foam insulator band within said entire volume in insulation defining relation, whereby said door, in its said panes, said horizontal frame members, and said vertical frame members, is fully insulated against heat transmission therethrough.

12. The rolling door according to claim 11, in which the male and female plastic foam insulator structures are self-camming, self-aligning and self-sealing when the door is in its closed condition.

13. The rolling door according to claim 11, in which at least one of said horizontal frame members has a lateral shoulder flange and a vertically disposed rib, said lateral shoulder flange blocking exit of the insulator band within said opposed edge volume, said rib engaging said band against vertical dislodgement from said opposed edge volume.

14. The rolling door according to claim 11, in which said recessed edge faces each have a lateral shoulder flange projecting into said recessed edge face and a vertically disposed rib, said lateral shoulder flange blocking exit of the insulator bands from within their respective recessed edge faces, said rib being oppositely directed and engaging respective one of said bands against vertical dislodgement from their respective recessed edge faces.

15. The rolling door according to claim 11, in which said frame members are made of aluminum.

16. The rolling door according to claim 11, in which said insulator bands comprise a urethane plastic.

17. A method of insulatively closing a large opening including disposing within said opening a rolling glass door of the articulating type, and insulating said door with multiple horizontally and vertically distributed insulative glass panes supported by a plurality of vertically disposed and horizontally disposed heat transmitting metal frame members arranged in vertical and horizontal regions respectively between adjacent glass panes, said horizontal frame members having opposed and recessed edge faces in the closed condition of the door, insulating said horizontal regions with preformed, self-supporting and cooperating male and female insulator bands that interfit only within an entire area of said recessed edge faces in the closed condition of the door in insulation defining relation in said horizontal regions, said vertical frame members defining a substantially enclosed volume, and insulating said vertical regions with an insulator band within said entire volume in insulation defining relation, whereby to insulate said door, in its said panes, said horizontal frame members, and said vertical frame members, against heat transmission therethrough, with an insulation material made of a solid, porous, layered, uniform, or particulate mass of mineral, plastic or cellulosic particles, webs, or fibers.

* * * * *